United States Patent [19]

Cho et al.

[11] Patent Number: 4,984,223

[45] Date of Patent: Jan. 8, 1991

[54] ANALOG STYLE ELECTRONIC WATCH

[75] Inventors: Wonjung Cho, Inchon; Kwangju Choi, Kyonggi, both of Rep. of Korea

[73] Assignee: Samsung Electronics Co., Ltd., Suwon, Rep. of Korea

[21] Appl. No.: 508,527

[22] Filed: Apr. 12, 1990

Related U.S. Application Data

[63] Continuation of Ser. No. 287,228, Dec. 21, 1988, abandoned.

[30] Foreign Application Priority Data

Dec. 31, 1987 [KR] Rep. of Korea ..... 87-15639

[51] Int. Cl.[5] ..... G04B 19/00; G04F 5/00

[52] U.S. Cl. ..... 368/76; 368/77; 368/160; 368/233

[58] Field of Search ..... 368/76, 77, 78, 157, 368/160, 221, 223, 228, 232, 233

[56] References Cited

U.S. PATENT DOCUMENTS 2,202,214 5/1940 Livingston et al. ..... 368/80

3,465,512 9/1969 Usui et al. ..... 368/285

3,712,046 1/1973 Dill ..... 368/77

4,426,159 1/1984 Kosaka et al. ..... 368/80

*Primary Examiner*—Vit W. Miska

*Attorney, Agent, or Firm*—Cushman, Darby and Cushman

[57] ABSTRACT

An analog style electronic watch employing an IC controlled electromagnetic system for driving concentrically mounted second, minute and hour ring indicators. Each ring has a plurality of equidistantly spaced permanent magnetic elements which enable the ring to be incrementally indexed by pulsed electromagnets. No gears or wheels are used. The electromagnets drive mechanism responds to clock pulses from the IC which supplies a core-wound electromagnet having asymmetric north-south poles for developing attractive and repulsive forces with respective to pairs of permanent magnet element on said rings. Asymmetry is achieved by varying the cross-sectional area of the core along the poles. The direction of ring rotation may be reversed by changing the direction of current flow in the winding.

5 Claims, 4 Drawing Sheets

VDD
VSS
CLOCK
11
DIVIDER
14
VOLTAGE REG.
12
I/O CIR.
17
RESET
13
PULSE WIDTH CONTROL
15
PULSE PERIOD GEN.
16a
PULSE PERIOD GEN.
16b
PULSE PERIOD GEN.
16c
16
OUTPUT TERMINALS
18
S1
S2
M1
M2
H1
H2

N <S

S < N

ANALOG STYLE ELECTRONIC WATCH

This is a continuation of application Ser. No. 07/287/228, filed Dec. 21, 1988 now abandoned.

BACKGROUND OF THE INVENTION

The present invention relates to an analog style electronic watch which indicates time continuously, as opposed to digitally and incrementally. The watch includes an inner integrated circuit for generating pulses for electromagnetically driving indicator wheels and does not use a step motor and gears as do conventional analog style watches.

As illustrated in FIG. 6, a prior art analog style electronic watch circuit includes a static voltage generating regulator 12 and divider 14 for dividing pulses from a clock 11 which generates pulses, input-output circuit 17 for testing the count status of divider 14, reset input circuit 13 for resetting pulse periods, a pulse width controller 15 for controlling width of the pulses, and a pulse period generator 16 for driving a motor. The integrated watch circuit also includes motor output terminal 18 for driving a step motor 19 which converts electric energy to mechanical energy.

Prior art analog style electronic watches of this construction divide pulses from clock 11 by the divider(14). When the divided frequency is applied to the pulse width generator 15 through input-output logic 17, the pulse width generator 15 generates motor driving pulses of a pulse width to drive the second hand. The step motor driving pulses are applied to the pulse period generator 16 which determines their period in order that the second hand properly indicates 60 seconds.

An example of an analog style electronic watch of this construction is shown in Japan Utility Model Specification SHO 57-9752.

The prior art watch of this type drives one wheel with a step motor and uses a gear in order to drive the minute and hour hands rings. Several problems occur with this construction.

That is, in the prior art analog watch, if the step motor drives the second hand wheel, and the second hand wheel drives other wheels (e.g., a center wheel, minute wheel, and hour wheel), there is the problem with precision. Also, life of watch becomes less due to abrasion of the contact parts.

Moreover, as shown in Japan Utility Model Specification SHO 57-9752, prior analog style electronic watches consume more power. The electric power of a step motor consumes about two-thirds of the total energy requirement.

SUMMARY OF THE INVENTION

It is therefore an object of the present invention to provide analog style electronic watch having a simplified driving circuit and which does not employ gears or a step motor for driving an hour hand, minute hand, and second hand rings of an analog style electronic watch.

To attain this object, the present invention employs two additional pulse period generators, namely, a pulse period generator for driving the hour hand and minute hand, while prior analog style watches, in addition to driving the second hand, also drives the minute hand and hour hand with a single pulse period generator.

Further, the new apparatus does not use a step motor and therefore attains another object of the invention, that is, to conserve power and reduce the size of the watch.

BRIEF DESCRIPTION OF THE DRAWINGS

These and other objects and advantages of the present invention will become clear from the following description with reference to the accompanying drawings, wherein.

DETAILED DESCRIPTION OF THE INVENTION

Figure 1:
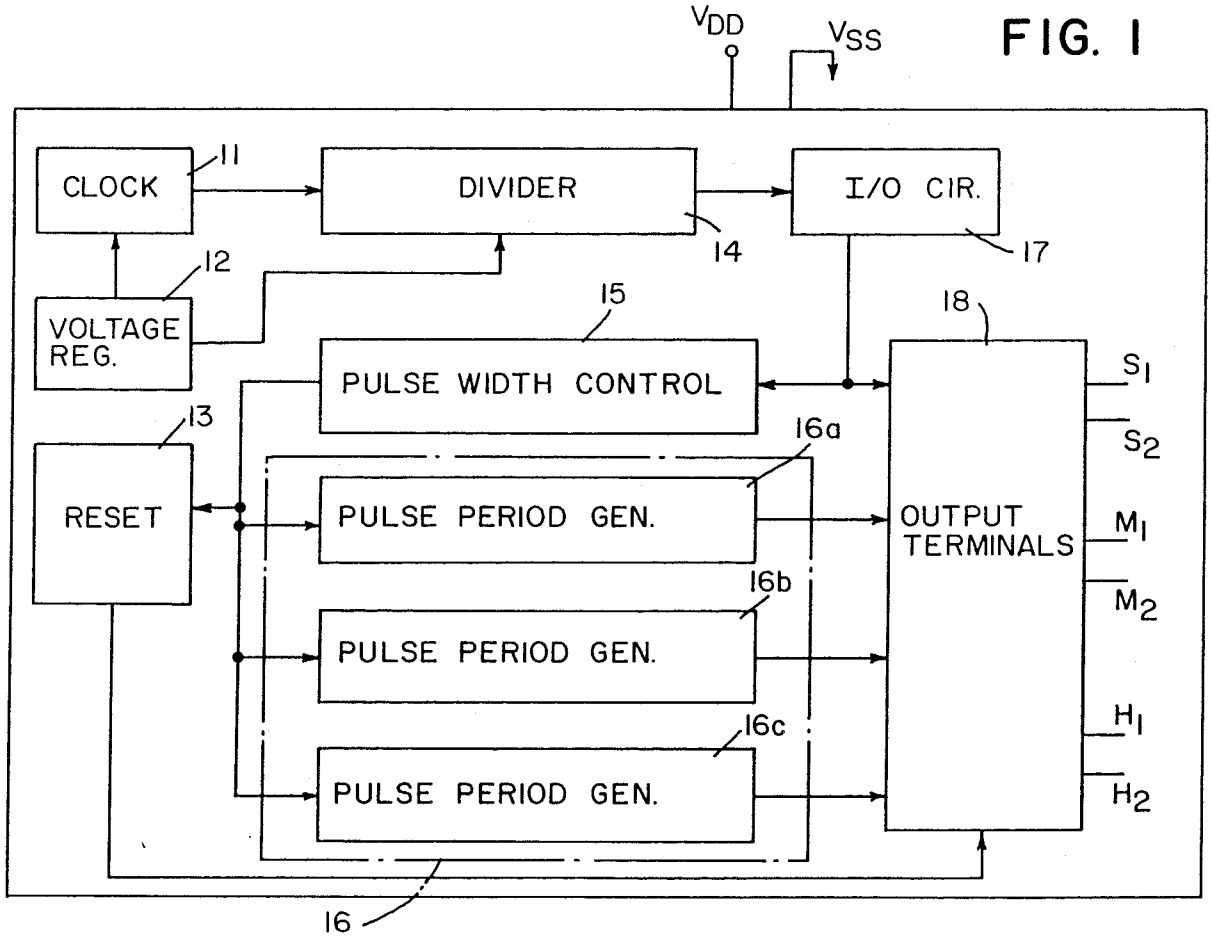
FIG. 1 is the block diagram of an integrated circuit of an analog watch of the present invention.
Figure 2:
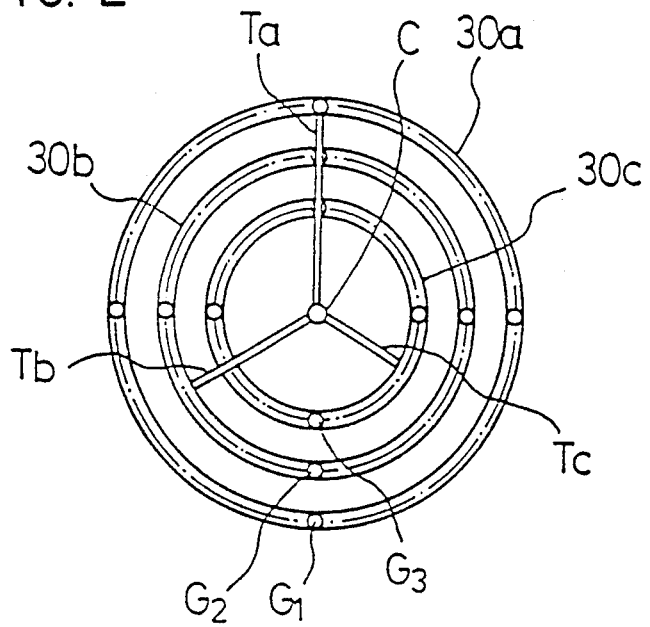
FIG. 2 depicts the construction of indicating rings of the present invention.

The analog style electronic watch of the present invention includes the internal integrated circuit of FIG. 1, and a ring indicator device for driving hour, minute, second hand display, as shown in FIG. 2.

As shown in FIG. 1, we add as an improvement over the prior art, a minute hand and hour hand pulse period generators 16*b* and 16*c*, in addition to the normal pulse period generator 16*a*. The integrated circuit (IC) of FIG. 1 includes a pulse width generator 15, a second hand ring driving pulse (S1,S2), and a minute hand ring driving pulse(M1,M2). The hour hand ring driving pulses have a constant period.

FIG. 2 illustrates a rear elevational view of the hand ring structure of the present invention. The supporting posts (Ta,Tb,Tc) are connected to the center wheel (C) of time display device, respectively, and support the second hand ring(30*a*), the minute hand ring(30*b*), and the hour hand ring(30*c*), respectively.

Thin plate permanent magnets(G1, G2) of sixty pieces are arranged N-S equidistantly on the second hand ring(30*a*) and the minute hand ring(30*b*). A thin plate permanent magnet(G3) of twelve pieces is arranged N-S on the hour hand ring(30*c*).

Figure 3:
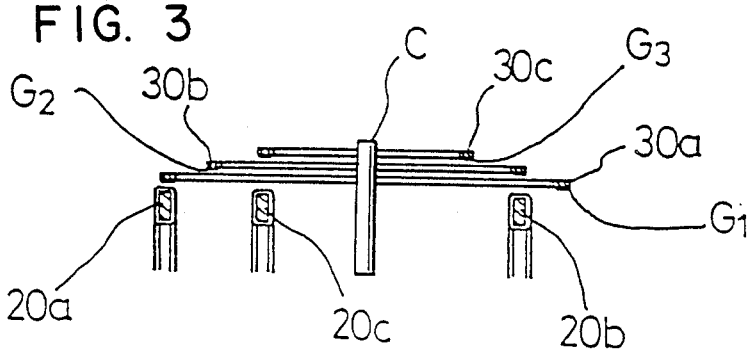
FIG. 3 is an illustration of a ring indicator and an electromagnetic driving structure of the present invention.

FIG. 3 is a cross-sectional view of the structure of FIG. 2.

It shows the construction that the supporting posts (Ta,Tb,Tc) and the second, minute, hour hand rings(-30*a*,30*b*,30*c*) are connected to the second, minute, hour hands driving wheel(C) in a regular order. Electromagnets(20*a*,20*b*,20*c*) place below each hand ring.

The electromagnets(20*a*,20*b*,20*c*) are disposed relative to the circumferential range of each ring 30*a*, 30*b*, and 30*c*in a manner relative to each other so as to avoid reciprocal magnetic interference. For example, each electromagnet is placed at an angle of 120° from each other around the center(c).

Figure 4A:
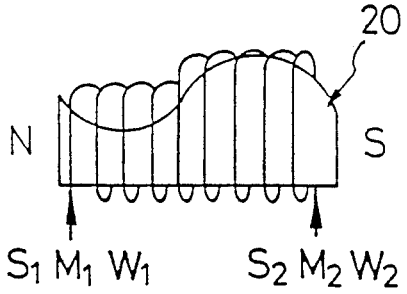
FIG. 4*a* and 4*b* illustrate electromagnets used in the present invention.
Figure 4B:
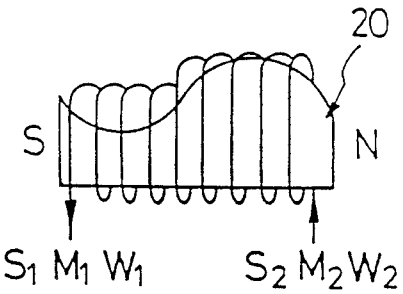

FIGS. 4*a* and 4*b* illustrate the electromagnet(20). As seen, wire is wound around an iron core F having a varying cross-sectional area along its length. Specifically, the core is constructed having less cross-sectional area on left the side of the iron core F, and an enlarged cross-sectional area on the right side of the iron core F.

One side of the wire is connected to one terminal of motor output terminal 18 of the said IC of FIG. 1, and the other side is connected to the other output terminal of motor terminal 18.

Figure 5A:
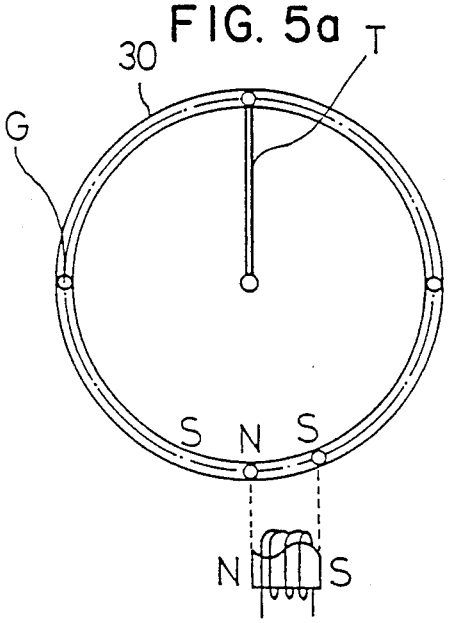
FIG. 5*a* and 5*b* show the relationship between a ring indicator an electromagnet of the present invention.
Figure 5B:
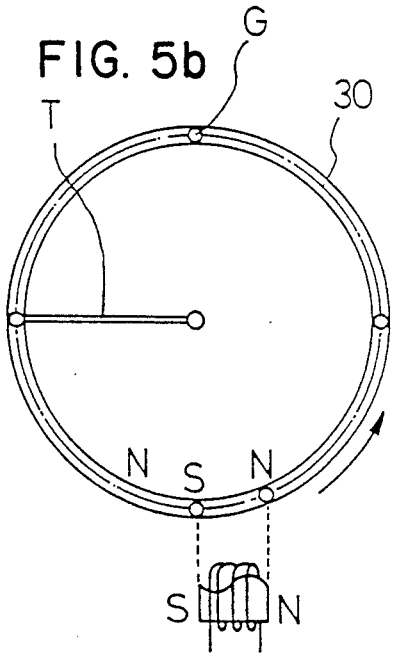
Figure 6:
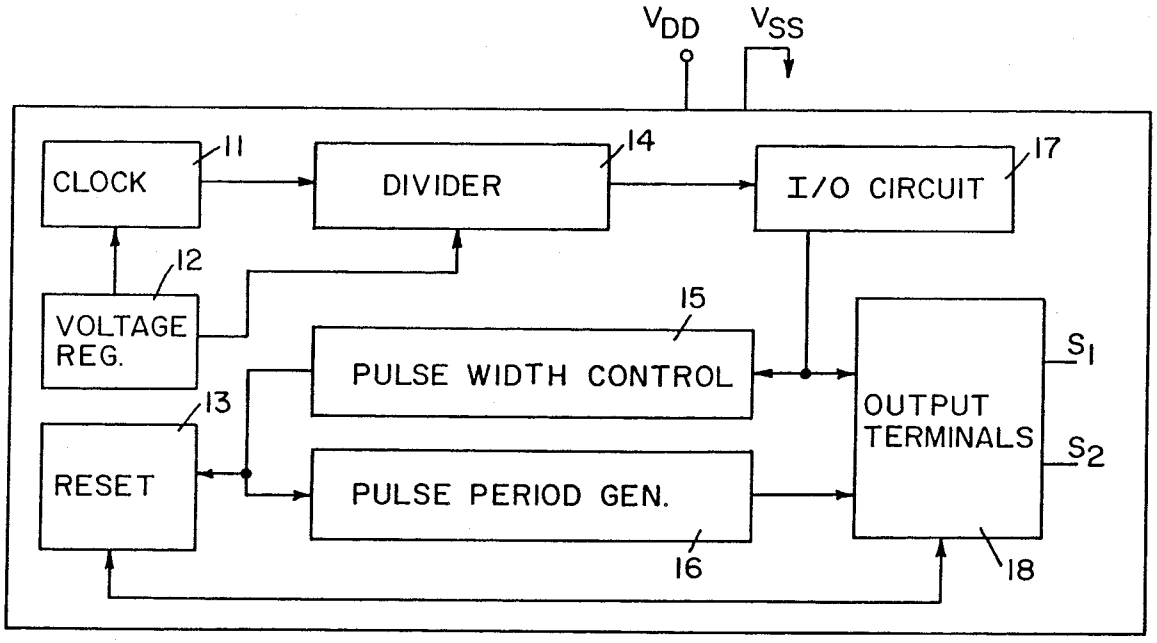
FIG. 6 PRIOR ART
FIG. 6 is a block diagram of an integrated circuit of a prior art analog watch.

FIGS. 5*a* and 5*b* illustrate the relationship between a hand ring 30 and an electromagnetic 20. It is constructed so that the length of electromagnet 20 is equal to the circumferential spacing of N-S poles of thin plate permanent magnet(G). The thickness of electromagnet 20 is equal to that of thin plate permanent magnet(G).

We now explain the process of the operation of the present invention as follows.

In the integrated circuit having the construction of FIG. 1, the frequency of clock generator 11 is divided by divider(14) and is applied to the pulse width generator 15. The pulse width generator 15 applies an output signal with random pulse width to the pulse period generators(16*a*,16*b*,16*c*), respectively. The pulse period generators(16*a*,16*b*,16*c*) produce the pulses(S1,S2,M1,M2,H1,H2) with the second hand, minute hand, hour hand driving period as a normal inner integrated circuit and also supplies the motor output terminal 18.

The motor output terminal 18 transfers the period pulses(S1,S2,M1,M2,H1,H2) respectively by the combination of conventional flip-flop and outputs to the output terminal individually.

In more detail, the motor output terminal 18 which is applied to the second hand ring outputs S1, S2 independently. The two pulses S1, S2 are outputted at one-second intervals.

Also, the minute hand ring driving pulses(M1,M2) and the hour hand ring driving pulses(H1,H2) are outputted to the motor output terminal 18. The periods of these pulses are different. That is, the minute hand ring driving pulses(M1,M2) indicate one-minute intervals and the hour hand ring driving pulses(H1,H2) indicate one-hour intervals.

The output pulses from the motor output terminal 18 are applied to the electromagnet 20 for the electromechanical convertor of FIGS. 4*a* and 4*b*. If the pulses(S1,M1,H1) applied to a terminal of the wire are high, it is formed with the "N" pole at the left side of electromagnet 20 and "S" pole at the right side, as shown in FIG. 4*a* . The "S" pole of the permanent magnet(G) and "S" pole of electromagnet 20 are repelled as shown in FIG. 5*a*, because "S" pole of the right side of electromagnet 20 is larger than "N" pole of the left side. As a result, the hand ring 30 rotates counterclockwise and takes the position as shown in FIG. 5*b*.

At this moment, if the hand ring driving pulses(S2,M2,H2) are high, there is formed a "N" pole at the right side of electromagnet 20 and "S" pole at the left side, as depicted in FIG. 4*b*, and the indicator plates(30*a*,30*b*,30*c*) rotate continuously.

The rate of rotation of the hand rings(30*a*,30*b*,30*c*) differs due to the frequency of each driving pulses(S1,S2,M1,M2,H1,H2).

If the hand rings(30*a*,30*b*,30*c*) rotate counterclockwise at different rates, the second hand, minute hand, hour hand adhered to the central wheel(c) by the supporting posts(T1,T2,T3), rotate clockwise, as shown in FIG. 2.

By the above operation, the present invention is able to drive analog style electronic watch without a gear, or a step motor. It therefore solves the shortcoming of prior analog style electronic which the time display device using many gears. On the other hand, there is an advantage that one can form a small analog style electronic watch which is operated by a minimum source of power. According to the small portable watch which uses a battery as the source of power, by using the electromagnet 20 which has the simple circuit construction, one can reduce the size of the watch.

What is claimed is:

1. An analog style electronic watch comprising:

A. a plurality of rings having discrete magnetic elements adapted to rotate about an axis for indicating respective units of time, B. a control circuit for generating drive pulses for each said ring, C. drive means for each of said plurality of rings responsive to said control circuit and being disposed in a magnetic relation with said magnetic elements of said rings, said drive means comprising electromagnetic means having a current winding for receiving said drive pulses, each of said electromagnetic means and the corresponding current winding generating asymmetric magnetic fields of alternating polarity in accordance with said drive pulses, whereby said asymmetric magnetic fields produce attractive and repulsive forces between respective magnetic elements on said rings thereby driving said ring about said axis.

2. An analog style electronic watch as recited in claim 1 wherein said electromagnetic means includes a magnetic core disposed in said current winding, said core having a non-uniform cross-sectional area for generating asymmetric magnetic fields to drive said ring.

3. An analog style electronic watch as recited in claim 1 wherein said plurality of rings comprise a thin-plate second hand ring, a thin-plate minute hand ring, and a thin-plate hour hand ring, and said control circuit includes respective second, minute and hour pulse generating means for driving the respective rings.

4. An analog style electronic watch as recited in claim 3 wherein said rings are concentrically mounted to rotate about a shaft, and said second hand ring includes sixty equidistantly spaced permanent magnetic elements, said minute hand ring includes sixty equidistantly spaced permanent magnetic elements, and said hour hand ring includes twelve equidistantly spaced permanent magnetic elements.

5. An analog style electronic watch as recited in claim 4 wherein said rings are circumferentially spaced from each other at a distance which eliminates an area of reciprocal magnetic interference.

* * * * *